US009101792B2

(12) United States Patent
Ho et al.

(10) Patent No.: US 9,101,792 B2
(45) **Date of Patent: *Aug. 11, 2015**

(54) ABDOMEN EXERCISE MACHINE

(71) Applicants: Wei-Teh Ho, Taipei (TW); Willy Ho, Taipei (TW)

(72) Inventors: Wei-Teh Ho, Taipei (TW); Willy Ho, Taipei (TW)

( * ) Notice: Subject to any disclaimer, the term of this patent is extended or adjusted under 35 U.S.C. 154(b) by 220 days.

This patent is subject to a terminal disclaimer.

(21) Appl. No.: 13/797,393

(22) Filed: Mar. 12, 2013

(65) Prior Publication Data

US 2014/0274616 A1 Sep. 18, 2014

(51) Int. Cl.

| | |
|---|---|
| ***A63B 26/00*** | (2006.01) |
| ***A63B 23/02*** | (2006.01) |
| ***A63B 21/00*** | (2006.01) |
| ***A63B 21/068*** | (2006.01) |
| *A63B 69/00* | (2006.01) |

(52) U.S. Cl.

CPC ..... *A63B 23/0211* (2013.01); *A63B 21/068* (2013.01); *A63B 21/1469* (2013.01); *A63B 21/1492* (2013.01); *A63B 21/1461* (2013.01); *A63B 2069/0062* (2013.01); *A63B 2208/0233* (2013.01)

(58) Field of Classification Search

CPC ..... A63B 23/0205; A63B 23/0211

USPC ..... 482/140, 142, 79–80, 148, 57, 70–71, 482/96, 92–95, 131, 133, 137, 908; 297/353

See application file for complete search history.

(56) References Cited

U.S. PATENT DOCUMENTS

| | | | | |
|---|---|---|---|---|
| 5,308,306 | A | 5/1994 | Wang | |
| 5,971,897 | A | 10/1999 | Olson et al. | |
| 6,152,866 | A | 11/2000 | Kuo | |
| 6,287,243 | B1 | 9/2001 | Isom et al. | |
| 6,716,144 | B1 * | 4/2004 | Shifferaw | 482/140 |
| 8,062,196 | B1 * | 11/2011 | Khubani | 482/140 |
| 8,235,876 | B2 | 8/2012 | Reyes | |

(Continued)

FOREIGN PATENT DOCUMENTS

| | | |
|---|---|---|
| DE | 20010072 | 8/2000 |
| DE | 20313843 | 11/2003 |
| DE | 202006008113 | 7/2006 |

OTHER PUBLICATIONS

EPO Communication for European Application No. 13189521.1 containing the Extended European Search Report and Opinion, (dated Jul. 14, 2014, received Feb. 26, 2015), 9 pages.

*Primary Examiner* — Loan H Thanh

*Assistant Examiner* — Megan Anderson

(74) *Attorney, Agent, or Firm* — Blakely Sokoloff Taylor Zafman LLP

(57) ABSTRACT

An exercise machine applicable for strengthening a user's abdominal muscles is described. The exercise machine can include a base frame having a seat pad, a front leg and a rear leg to provide ground support. A mounting assembly a front pivot joint and a rear pivot joint may be rotably mounted on the base frame. A backrest assembly including a backrest pad, lever bars and backrest support bars can be pivotally coupled to the mounting assembly. The front ends of the backrest support bars can be pivotally coupled to the front pivot joint. The front ends of the level bars can be pivotally coupled to the rear pivot joint. The swivel movements can be controlled via a adjustable control mechanism including a height control adjustably attached to the mounting assembly to provide a stop height support of the backrest pad at the rear end of the backrest bars.

13 Claims, 6 Drawing Sheets

(56) References Cited

U.S. PATENT DOCUMENTS

2004/0067831 A1 4/2004 Hou
2004/0067931 A1 4/2004 Kelly et al.
2007/0259762 A1* 11/2007 Ho ..... 482/142
2008/0051274 A1 2/2008 Greene
2009/0105054 A1* 4/2009 Boland et al. ..... 482/140
2009/0186749 A1 7/2009 Zhou
2012/0058867 A1 3/2012 Mishan et al.
2012/0065037 A1* 3/2012 Chen et al. ..... 482/140

* cited by examiner

ABDOMEN EXERCISE MACHINE

FIELD OF INVENTION

The present invention relates generally to physical training machines, and in particular, exercise machines structured to support twistable body bending for exercising the abdominal muscles of a user.

BACKGROUND

With the growing awareness of health problems caused by lack of exercise, popularity of exercising machines has been continuously increasing. Typically, these machines are designed for movements of specific parts of the body. For example, abdominal machines may be structured to induce body exercises to strengthen the abdominal muscles.

Existing abdominal machines, however, are usually designed based on variations of sit-ups exercises. Effective abdominal exercises may require a combination of movements involving muscles of different parts of the body including the waist, legs, etc. Although there are many exercising machines available for exercising different parts of the body, these multipurpose exercising machines are usually heavy and expensive devices. Further, these devices are often directed for a user to perform one degree of exercise movements at a time.

Therefore, traditional abdomen machines are not structured economically and effectively to facilitate a user to exercise abdomen muscles with multi degrees of movements at a time.

SUMMARY OF THE DESCRIPTION

An exercise machine supporting twistable body bending for strengthening a user's abdominal muscles (e.g. allowing twistable pivoting movements) can include a base frame having a seat pad, a front leg and a rear leg. The seat pad can be elevated with the front legs and rear legs to provide ground support. A mounting assembly may be rotatably mounted on the base frame over the rear legs. The mounting assembly can have a front pivot joint and a rear pivot joint. A backrest assembly can be pivotally coupled to the mounting assembly via the front pivot joint and the rear pivot joint for swivel movements along the base frame. The backrest assembly can include a backrest pad, lever bars and backrest support bars affixed to the backrest pad. The front ends of the backrest support bars can be pivotally coupled to the front pivot joint. The front ends of the level bars can be pivotally coupled to the rear pivot joint. The swivel movements can be controlled via a adjustable control mechanism. A user resting against the backrest pad can be allowed to cause the swivel movements while sitting on the seat pad. The adjustable control mechanism can include a height control adjustably attached to the mounting assembly to provide a stop height support of the backrest pad at the rear end of the backrest bars.

Other advantages and features of the present invention will become manifest to those versed in the art upon making reference to the detailed description and the accompanying sheets of drawings in which a preferred structural embodiment incorporating the principles of the present invention is shown by way of illustrative example.

BRIEF DESCRIPTION OF THE DRAWINGS

The present invention is illustrated by way of examples and not limitations in the figures of the accompanying drawings, in which like references indicate similar elements and in which.

DETAILED DESCRIPTION

In the following description, numerous specific details are set forth, such as examples of external surfaces, named components, connections between components, etc., in order to provide a thorough understanding of the present invention. It will be apparent, however, to one skilled in the art that the present invention may be practiced without these specific details. In other instances, well known components or methods have not been described in detail but rather in a block diagram in order to avoid unnecessarily obscuring the present invention. Further specific numeric references such as first, second, third, etc., may be made. However, the specific numeric references should not be interpreted as a literal sequential order but rather interpreted as references to different objects. Thus, the specific details set forth are merely exemplary. The specific details may be varied from and still be contemplated to be within the spirit and scope of the present invention.

Reference in the specification to "one embodiment" or "an embodiment" means that a particular feature, structure, or characteristic described in connection with the embodiment can be included in at least one embodiment of the invention. The appearances of the phrase "in one embodiment" in various places in the specification do not necessarily all refer to the same embodiment.

Figure 1:
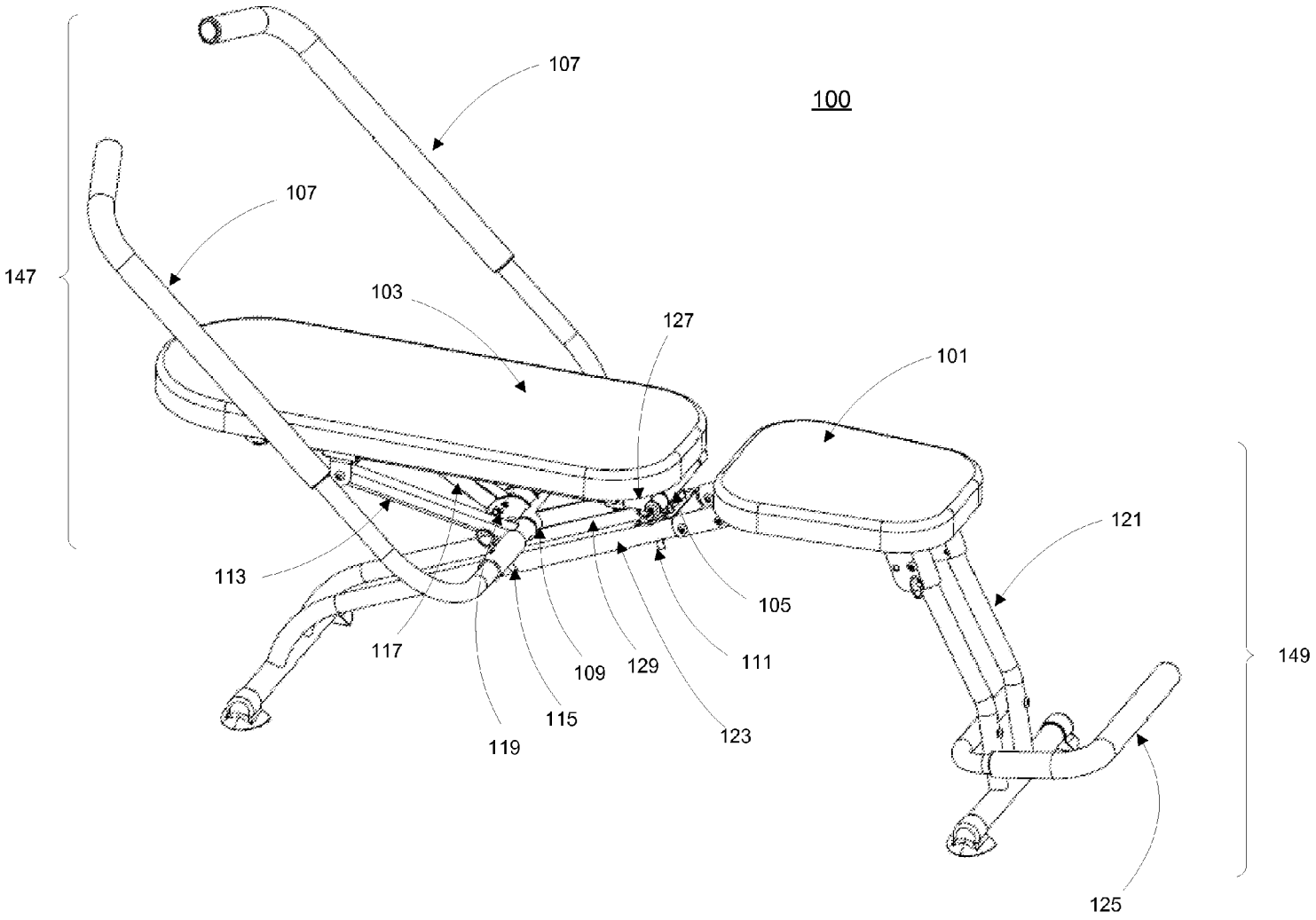
FIG. 1 is a perspective view of an embodiment of an exercise machine assembly.

FIG. 1 is a perspective view of an embodiment of an exercise machine assembly. Exercise machine (or device) 100 can include pivoting frame 147 rotatably mounted on a mounting location of base frame 149 to allow pivoting frame 147 to move rotationally and/or pivotally around the mounting location for a user to perform twisting motions along multiple rotational or bending degrees for exercising.

Base frame 149 can provide floor (or ground) support for movements of pivoting frame 147. In one embodiment, base frame 149 may be oriented longitudinally along a rear side and a front side. Seat pad 101 may be affixed to base frame 149. Seat pad 101 may be elevated to provide seating support for a user of exercise machine 100. Base frame 149 may include front legs 121 on the front side and rear legs 123 on the rear side. Foot rest bar 125 may be detachably affixed to front legs 121 to provide foot support for a user sitting on seat pad 101.

Pivoting frame 147 may be rotatably mounted on base frame 149 via mounting assembly 129 over real legs 123 to allow pivoting frame 147 to be longitudinally oriented (e.g. aligned) or having an angular relationship with a longitudinal direction of base frame 149. Mounting assembly 129 can include front pivot joint 105 and rear pivot joint 109 to enable pivot movements of pivoting frame 147. Thus, a user of device 100 can sit on seat pad 101 of base frame 149 to perform exercise movements folding or twisting the user's upper body via the pivot movements of pivoting frame 147.

In one embodiment, pivot frame 147 can include a backrest assembly pivotally coupled to mounting assembly 129 via front pivot joint 105 and rear pivot joint 109. The backrest assembly can include backrest pad 103, handle bars 107, lever bars 113 and backrest support bars 127. Backrest pad 103 can provide support to a user's upper back to make bending or twisting movements via pivot frame 147 while sitting on seat pad 101. Backrest support bars 127 may be fixedly attached to the backside of backrest pad 103.

In one embodiment, pushing/resisting forces may be applied via the backside of backrest pad 103 for pivoting movements of pivoting frame 147 via lever bars 113. For example, the front lever ends of lever bars 113 towards the front (or forward) direction of backrest pad 103 may be pivotally coupled with mounting assembly 129 at rear pivot joint 109. Lever bars 113 may rotate pivotally around rear pivot joint 109 to push or receive backrest pad 103 via the rear ends (or lower ends) of lever bars 113.

Handle bars 107 may be affixed adjustably to the lower ends of lever bars 113 in a transverse manner at rear pivot joint 109. A user may apply force to rotate lever bars 113 back and forth to cause pivoting movements of pivoting frame 147 via hands holding handle bars 113. Angular relationships between handle bars 107 and backrest pad 103 may be adjusted via selectable positions for pin insert 115 of a locking mechanism of handle bars 107 at rear pivot joint 109. A user may make push/pull efforts through handle bars 107 to cause backrest pad 103 to pivot around front pivot joint 105.

In one embodiment, device 100 may include an adjustable control mechanism to control swivel movements (e.g. multi-degrees or dimensions of rotational and/or pivoting or other applicable motions) of pivoting frame 147 via mounting assembly 129 including front pivot joint 105 and rear pivot joint 109. The adjustable control mechanism can include position bar 117 of a height control and alignment pin insert 111 to provide constraints on movement paths or manners of pivot frame 147.

Position bar 117 may be adjustably attached to the rear end or rear side of mounting assembly 129 to configure a stop height or a lowest level for backrest pad 103 to pivot backwards. In one embodiment, height control 117 may be pivotally positioned around rear pivot joint 109 at the lower end of height control 117 via one of a fixed number (e.g. 4, 5, 6 or other applicable number) of apertures 119. Each aperture 119 may correspond to a different height at the higher end of position bar 117 to stop the rear end of backrest pad 103 to define, for example, a starting position for a user to make forward swivel, bending or pivoting movements.

In one embodiment, alignment pin 111 can be inserted to latch rotational positions between base frame 149 and pivoting frame 147. Thus, when alignment pin 111 is inserted, backrest pad 103 and seat pad 101 may be substantially aligned longitudinally to allow a user to focus on body pivoting movements without rotational twisting effects. Without alignment pin 111 (e.g. when removed), backrest pad 103 and seat pad 101 may not be aligned to cause twisting or swiveling forces for exercising. Backrest pad 103 and seat pad 101 may be positioned with enough space in between each other to allow rotational and/or pivoting movements of backrest pad 103.

Figure 2:
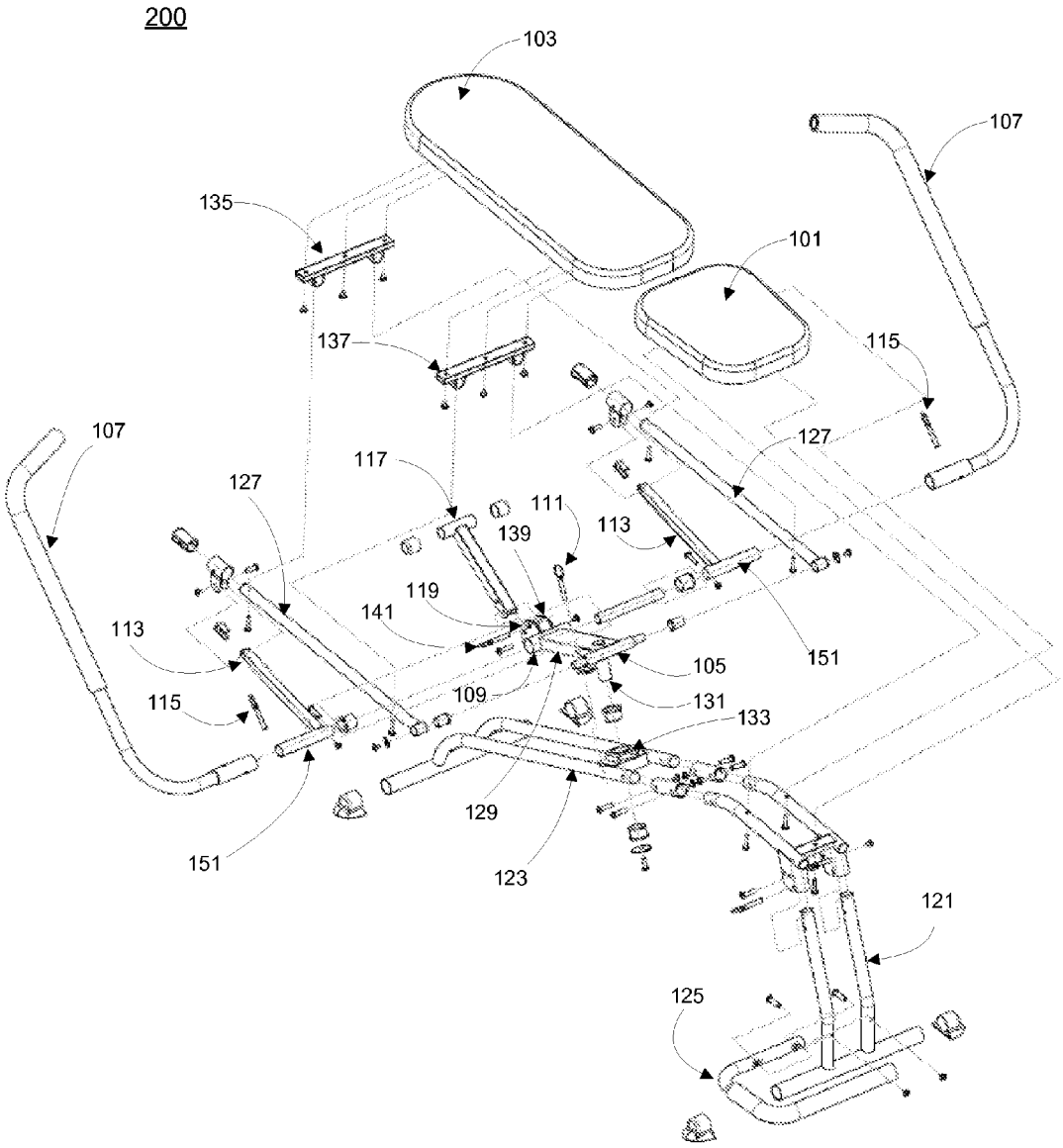
FIG. 2 is an exploded perspective view of an embodiment of an exercise machine assembly.

FIG. 2 is an exploded perspective view of an embodiment of an exercise machine assembly as shown in FIG. 1. For example, the backrest assembly can include backrest support brackets 135, 137 fixedly attached to the backside of backrest pad 103 transversely. The backrest assembly can further include backrest support bars 127 affixed to backrest pad 103 via backrest support brackets 135, 137. Backrest support bars 127 may be pivotally coupled to front pivot joint 105 via the front ends of backrest support bars 127 to enable pivoting movement of, for example, backrest pad 103.

In one embodiment, the rear ends (or upper ends) of lever bars 113 may be slidably coupled (e.g. separately on left and right sides under backrest pad 103) with the backrest support bars 127 in a pivoting manner. Thus, the rear ends of lever bars 113 can slide or move longitudinally across backrest support bars 127 while pivoting around rear pivot joint 109 to allow lever bars 113 to apply pushing or resisting forces for the pivoting movement of backrest support bars 127.

In some embodiments, the backrest assembly can include pivot rods 151 (one or more) detachably affixed transversely to lever bars 113 at the rear ends of the lever bars 113. Pivot rods 151 may be pivotably attached to rear pivot joint 109 of the mounting assembly. Handles bars 107 may be detachably affixed to pivot rods 151 to form an adjustable angular relationship between handle bars 107 and backrest pad 103 via, for example, pin insert 115 to facility hand gripping.

Receiver structure 133 of base frame 149 of FIG. 1 may have a center opening directed upward, e.g. substantially perpendicular to the longitudinal direction of rear legs 123. Mounting assembly 129 in pivoting frame 147 of FIG. 1 may have a protruding rod 131 extending downwardly into the center opening of receiver structure 133 for mounting base frame 149 with pivoting frame 147. Protruding rod 131 may be arranged transversely to pivot joint 105 to allow mounting assembly 129 to rotate around receiver structure 133.

According to one embodiment, mounting assembly 129 may include position locking structure 139 arranged near rear pivot joint 109. Position locking structure 139 may be configured with apertures 119 circumferentially spaced (e.g. equally) to adjustably lock in position bar 117 pivotally for a height control. The lower end of position bar 117 may be pivotally affixed to position locking structure 139 includes via height locking pin 141 selecting one of apertures 119.

Figure 3:
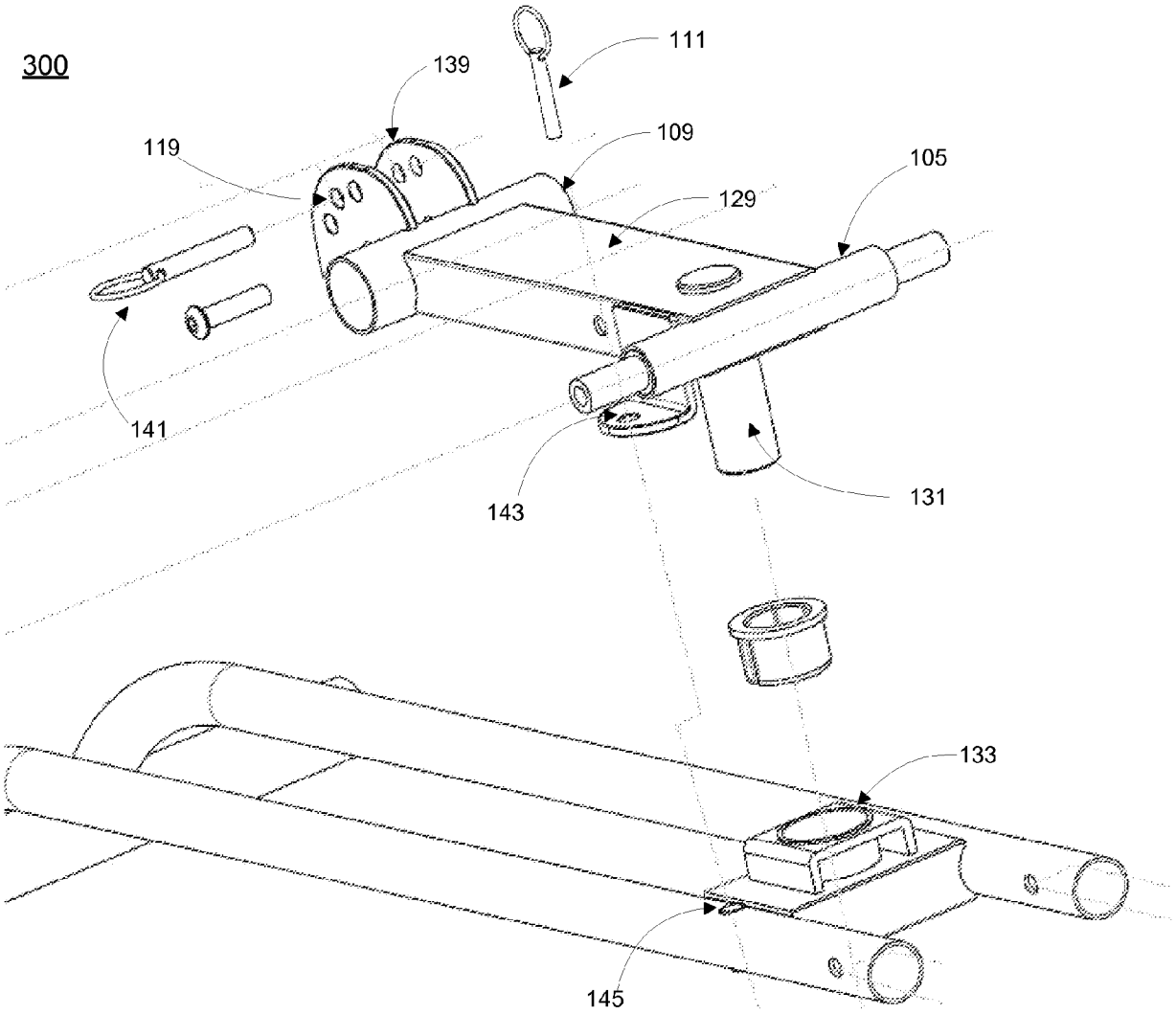
FIG. 3 is a detailed perspective view on a portion of an exercise machine assembly.

FIG. 3 is a detailed perspective view on a portion of an exercise machine assembly as shown in FIG. 1. For example, mounting assembly 129 can include upper latching hole 143. Base frame 149 can include lower latching hole 145 to be mated with upper latching hole 143. Alignment pin insert 111 can be inserted (or latched) through upper latching hole and lower latching hole 143 to confine the swivel movements of pivoting frame 149 of FIG. 1.

Figure 4:
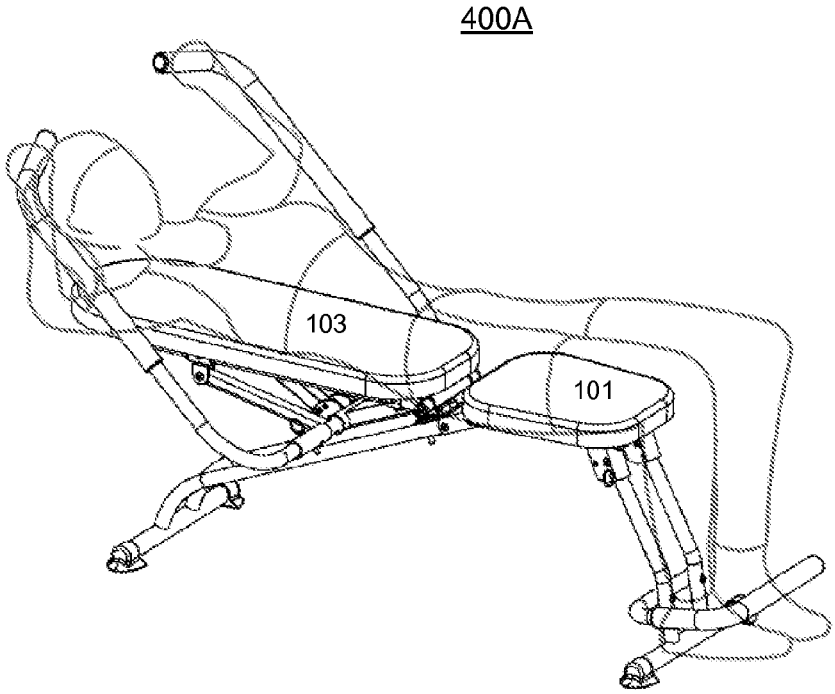
FIG. 4 shows a first example of an application of an exercise machine according to one embodiment of the present invention.
Figure 4:
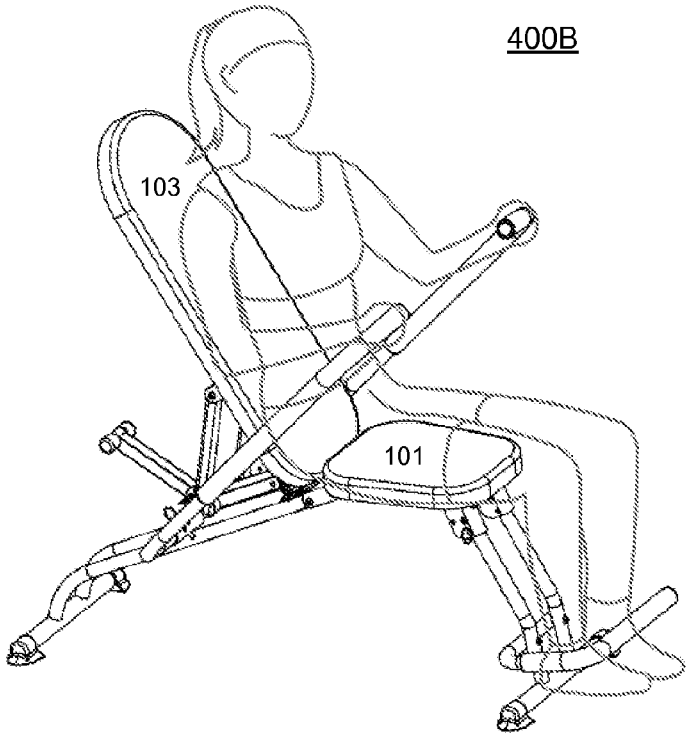

FIG. 4 shows a first example of an application of an exercise machine according to one embodiment of the present invention, such as device 1 of FIG. 1. In one embodiment, backrest pad 103 and seat pad 101 may be latched, for example, via alignment pin insert 111 of FIG. 1, to be aligned longitudinally together. Starting positions (e.g. lowest positions of the upper end) of backrest pad 103 may be configured via, for example, position control bar 117 of FIG. 1 with four different degrees of pivoting positions. A user could apply arm strength and/or waist strength to perform supine actions up and down as shown in examples 400A-400B.

Figure 5:
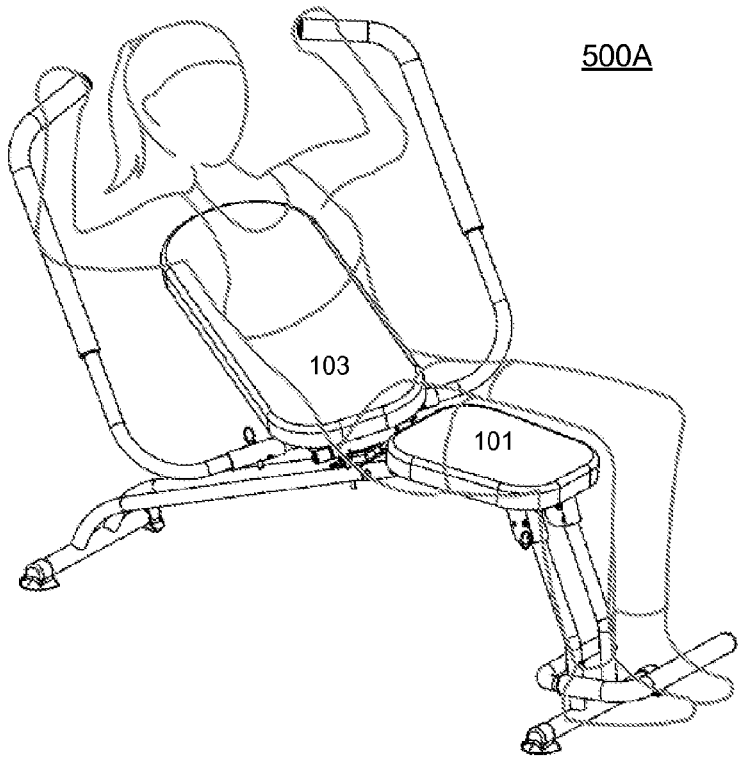
FIG. 5 shows a second example of an application of an exercise machine according to one embodiment of the present invention.
Figure 5:
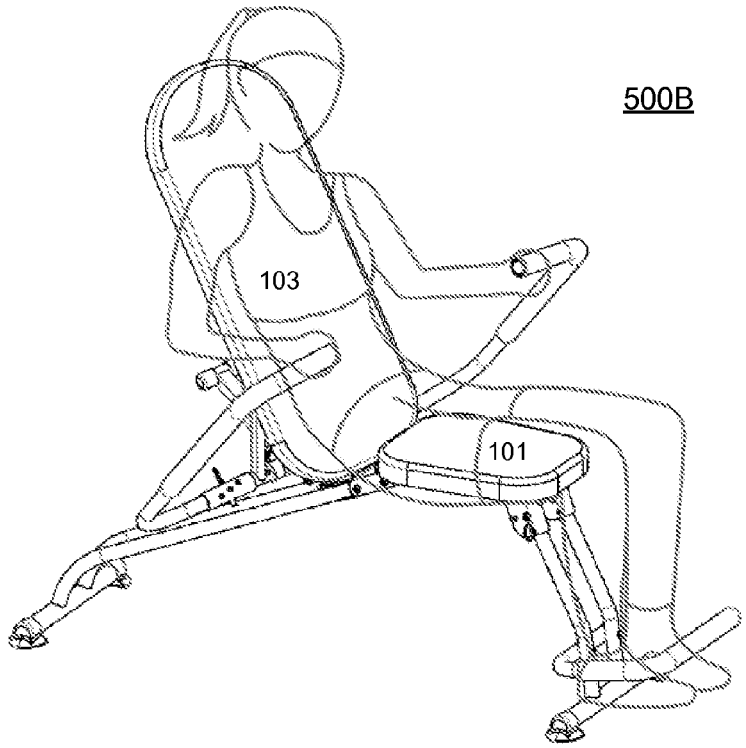

FIG. 5 shows a second example of an application of an exercise machine according to one embodiment of the present invention, such as device 100 of FIG. 1. Without being latched, for example, via alignment pin insert 111 of FIG. 1, backrest pad 103 may twist or swivel freely relative to seat pad 101. The starting height of backrest pad 103 can be adjusted via, for example, position control bar 117 of FIG. 1. A user could perform pivoting movements with right twisting as shown in examples 500A-500B.

Figure 6:
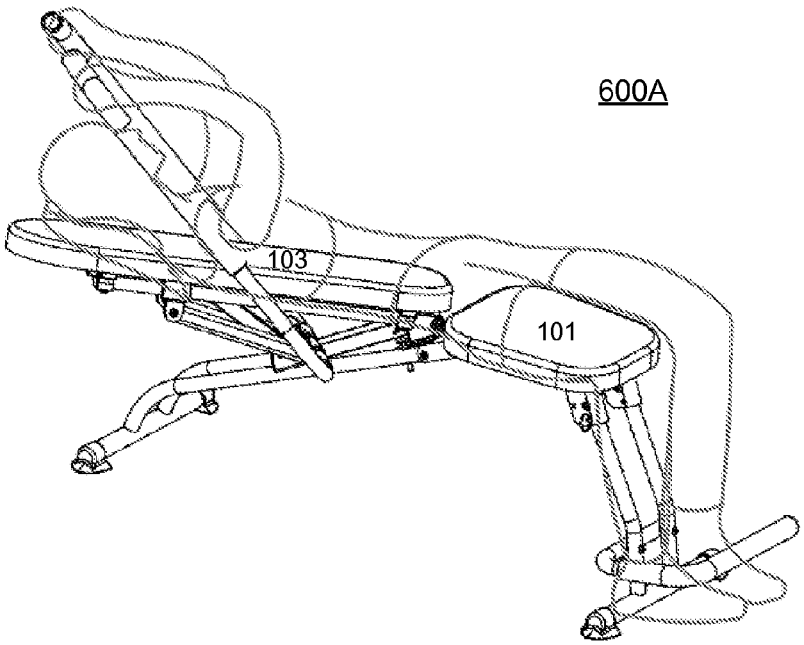
FIG. 6 shows a third example of an application of an exercise machine according to one embodiment of the present invention.
Figure 6:
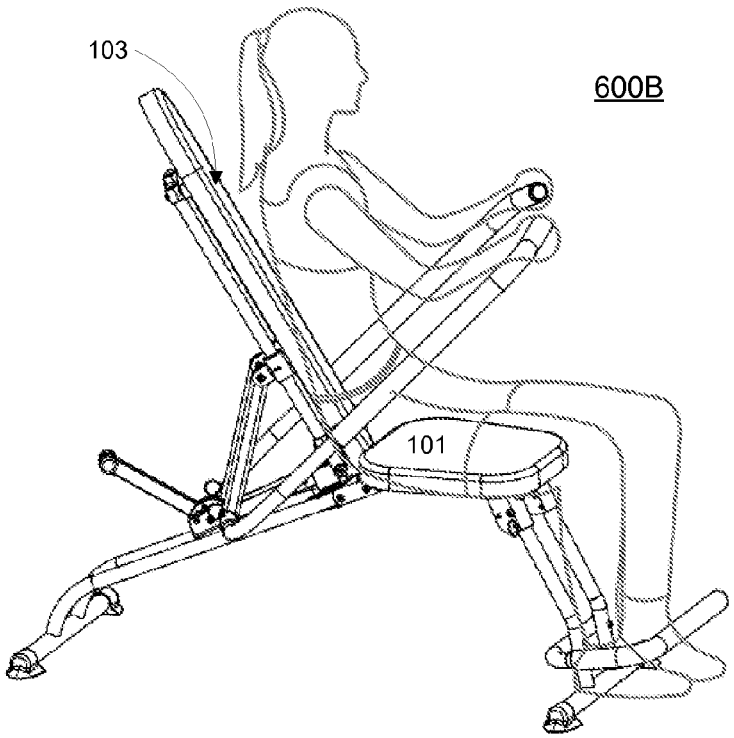

FIG. 6 shows a third example of an application of an exercise machine according to one embodiment of the present invention, such as device 100 of FIG. 1. In one embodiment, a user could perform pivoting movements with left twisting as shown in examples 600A-600B.

Many modifications and other embodiments of the invention set forth herein will come to mind to one skilled in the art to which the invention pertains having the benefit of the teachings presented in the foregoing description and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. An exercising machine comprising:

a base frame having a seat pad, a front leg and a rear leg, the seat pad elevated with the front leg and rear legs to provide ground support;

a mounting assembly rotatably mounted on the base frame over the rear leg a rotatable structure, the mounting assembly having a front pivot joint and a rear pivot joint, the rotatable structure arranged between the front pivot joint and the rear pivot joint along a longitudinal direction of the mounting assembly, the rotatable structure to allow the mounting assembly to rotate transversely to the front pivot joint;

a backrest assembly pivotally coupled to the mounting assembly via the front pivot joint and the rear pivot joint for swivel movements along the base frame, the backrest assembly including a backrest pad, lever bars and backrest support bars affixed to the backrest pad, front ends of the backrest support bars pivotally coupled to the front pivot joint, front ends of the lever bars pivotally coupled to the rear pivot joint; and an adjustable control mechanism to control the swivel movements to allow a user resting against the backrest pad to cause the swivel movements while sitting on the seat pad, the adjustable control mechanism including a height control adjustably attached to the mounting assembly to provide a stop height support of the backrest pad at the rear end of the backrest bars.

2. The exercising machine of claim 1, wherein the mounting assembly includes an upper latching hole, wherein the base frame includes a lower latching hole, and wherein the adjustable control includes an alignment pin to latch rotational positions between the seat pad and the backrest pad when the alignment pin is inserted through both the upper latching hole and the lower latching hole.

3. The exercising machine of claim 2, wherein the backrest pad and the seat pad are substantially aligned longitudinally to confine the swivel movements to pivot between the front legs and the rear legs when the upper latching hole and the lower latching hole are latched via the alignment pin.

4. The exercising machine of claim 1, wherein the mounting assembly further includes a position locking structure near the rear pivot joint, wherein the height control includes a position bar having a higher end and a lower end, the position bar pivotally affixed to the position locking structure via the lower end with an adjustable pivoting position, the higher end positioned at an adjustable height corresponding to the adjustable pivoting position to provide the stop height support of the backrest pad.

5. The exercising machine of claim 4, wherein the position locking structure includes apertures circumferentially spaced for the adjustable pivoting position, and wherein the height control includes a height locking pin to engage the position bar and the position locking structure via one of the apertures.

6. The exercising machine of claim 1, wherein the base frame includes a receiver structure having a center opening, wherein the mounting assembly has a protruding rod extending into the center opening to allow the mounting assembly to rotate around the receiver structure of the base frame.

7. The exercising machine of claim 1, wherein the backrest assembly further includes backrest support brackets transversely affixed to the backrest pad, wherein the backrest support bars are engaged with the support brackets along a back surface of the backrest.

8. The exercising machine of claim 1, further comprising handle bars adjustably affixed transversely to the lever bars to enable the swivel movements.

9. The exercising machine of claim 8, wherein the backrest assembly includes a pivot rod detachably affixed to the lever bars at the rear ends of the lever bars, the pivot rod pivotably attached to the rear pivot joint of the mounting assembly, wherein the handle bars are affixed adjustably to both ends of the pivot rod to allow separate angular relationships between the handle bars and the backrest pad.

10. An exercising machine comprising:

a base frame to provide floor support, the base frame arranged longitudinally between a front side and a rear side, the base frame including a seat pad affixed on top of the base frame; and a pivoting frame rotatably mounted on the rear side of the base frame via a rotatable structure, the pivoting frame having a backrest assembly, a mounting assembly and handle bars, wherein the backrest assembly has a backrest pad and lever bars, the backrest pad pivotally coupled with the level bars, wherein the mounting assembly has a front pivot joint and a rear pivot joint, the backrest pad pivotally coupled with the mounting assembly at the front pivot joint, the lever bars pivotally coupled with the mounting assembly at the rear pivot joint, the rotatable structure arranged between the front pivot joint and the rear pivot joint along a longitudinal direction of the mounting assembly, the rotatable structure to rotationally engage with the base frame for the rotatable mounting to allow an angular relationship between longitudinal directions of the seat pad and the backrest pad, wherein the handle bars are transversely affixed to the lever bars to allow a user to make push/pull force to cause the backrest pad to pivot around the front pivot joint, and wherein the angular relationship allows twisting effects on the user while exercising with the backrest pad pivoting around the first pivot joint.

11. An exercising machine comprising:

a base frame having a seat pad, a front leg and a rear leg, the seat pad elevated with the front leg and rear leg to provide round support;

a mounting assembly rotatably mounted to the base frame over the rear leg via a rotatable structure, the mounting assembly having at least two pivot joints, the rotatable structure arranged between the at least two pivot joints to along a longitudinal direction of the mounting assembly, the rotatable structure to allow the mounting assembly to rotate transversely to the pivot joints; and a backrest assembly movably coupled to the mounting assembly via the at least one pivot joint for swivel movements along the base frame, the backrest assembly including a backrest pad and handle bars, wherein the handle bars allow a user resting against the backrest pad to control the swivel movements while sitting on the seat pad.

12. The exercising machine of claim 11, wherein the swivel movements include multi-dimensional rotational motions of the backrest assembly relative to the base frame.

13. The exercising machine of claim 12, wherein the rotational motions include up down pivoting with left right twisting.

* * * * *